US008555453B2

(12) United States Patent
Winkler

(10) Patent No.: US 8,555,453 B2
(45) Date of Patent: Oct. 15, 2013

(54) DEVICE FOR REMOVING RESIDUE IN A FURNACE CHAMBER

(75) Inventor: Erhard Winkler, Rödental (DE)

(73) Assignee: Saint-Gobain Industriekeramik Rodental GmbH, Rodental (DE)

( * ) Notice: Subject to any disclaimer, the term of this patent is extended or adjusted under 35 U.S.C. 154(b) by 0 days.

(21) Appl. No.: 13/392,841

(22) PCT Filed: Jul. 29, 2010

(86) PCT No.: PCT/EP2010/061034
§ 371 (c)(1),
(2), (4) Date: May 9, 2012

(87) PCT Pub. No.: WO2011/032771
PCT Pub. Date: Mar. 24, 2011

(65) Prior Publication Data

US 2012/0210534 A1 Aug. 23, 2012

(30) Foreign Application Priority Data

Sep. 16, 2009 (DE) ..... 10 2009 041 697

(51) Int. Cl.
*B08B 9/08* (2006.01)
*F23J 3/00* (2006.01)

(52) U.S. Cl.
USPC ..... 15/249.2; 15/236.01

(58) Field of Classification Search
USPC ..... 15/236.01, 249.2, 249.3
See application file for complete search history.

(56) References Cited

U.S. PATENT DOCUMENTS

| | | | | | |
|---|---|---|---|---|---|
| 1,777,815 | A * | 10/1930 | Weigant | 15/104.069 |
| 4,028,769 | A * | 6/1977 | Coviello et al. | 15/249.3 |
| 4,511,125 | A | 4/1985 | Hochstrasser et al. | |
| 4,747,177 | A * | 5/1988 | Drechsel | 15/104.069 |
| 5,333,349 | A * | 8/1994 | Lister | 15/235.8 |
| 7,993,467 | B2 * | 8/2011 | Tsuchie et al. | 134/6 |
| 2008/0282486 | A1 * | 11/2008 | Pingel | 15/104.063 |

FOREIGN PATENT DOCUMENTS

| | | |
|---|---|---|
| DE | 2924445 | 1/1981 |
| DE | 3442091 | 5/1985 |
| DE | 19916368 | 10/2000 |
| GB | 464785 | 4/1937 |

OTHER PUBLICATIONS

PCT International Search Report for PCT/EP2010/061034 filed on Jul. 29, 2010 in the name of Saint-Gobain Industriekeramik Rodental GmbH (German and English).
PCT Written Opinion for PCT/EP2010/061034 filed on Jul. 29, 2010 in the name of Saint-Gobain Industriekeramik Rodental GmbH (German only).

* cited by examiner

*Primary Examiner* — Randall Chin
(74) *Attorney, Agent, or Firm* — Steinfl & Bruno, LLP

(57) ABSTRACT

The invention relates to a device for removing residue in a furnace chamber of a furnace, in particular a sintering furnace, comprising a scraper frame which is designed in such a way that it can be inserted into the furnace chamber and moved in the latter, and also at least one scraper element, which is arranged on the scraper frame in such a way that, by means of the scraper element, the residue can be removed at least on side walls and/or a ceiling of the furnace chamber when the scraper frame is moved. With said device, it should be possible to remove deposits in the furnace chamber in a simple and efficient manner without substantially impairing the progress of production.

18 Claims, 3 Drawing Sheets

DEVICE FOR REMOVING RESIDUE IN A FURNACE CHAMBER

CROSS REFERENCE TO RELATED APPLICATIONS

Figure 1:
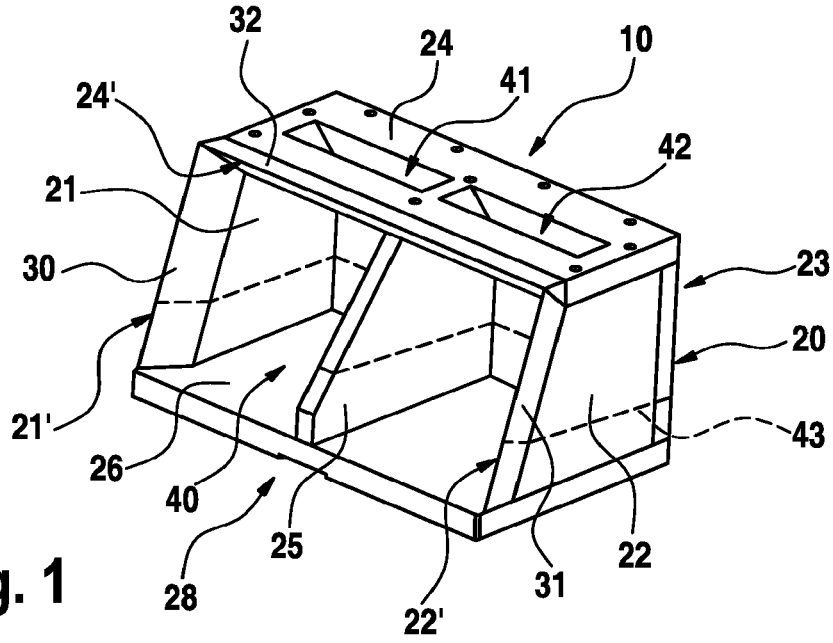

The present application is the US national stage of International Application PCT/EP2010/061034 filed on Jul. 29, 2010 which, in turn, claims priority to German Patent Application 10 2009 041 697.8 filed on Sep. 16, 2009.

The invention relates to a device for removing residues in a furnace chamber or charging chamber of a furnace, in particular of a sintering furnace.

Sintering of shaped parts takes place, in particular, for series production, preferably in continuous furnaces, e.g., in resistance heated or inductively heated furnaces with carbon lining of the furnace chamber. Thus, for example, diesel particle filters based on recrystallized silicon carbide (RSiC) are sintered at approx. 1900° C. to 2400° C. in such furnaces. The goods to be sintered can be pushed through the furnace on so-called push plates.

Sintering additives and impurities that are introduced along with the materials vaporize during the sintering process. Typical vaporization products are alkalis and silicon dioxide ($SiO_2$). Depending on the gas plumbing in the furnace, the vaporization products are discharged from the furnace or, as is the case with continuous furnaces, flushed in the direction of heating or cooling zones.

In continuous sintering furnaces, a consistent temperature profile is developed over the length of the furnace. Consequently, condensation and formation of new phases occur concentrated in one zone, in the area of the condensation temperature or reaction temperature. If the respective condensation temperature is exceeded, deposition of impurities occurs. In addition, vaporization products, such as, e.g. $SiO_2$, can react with the graphite lining of the furnace to form silicon carbide, which results in crust formation through formation of a new phase on the graphite lining.

The formation of deposits reduces the free cross-section of the furnace significantly such that problem-free transport of the charge, i.e., the goods, through the furnace is no longer ensured.

Until now, the deposits have been manually scraped out of the furnace chamber or charging chamber, and long furnace down times must be accepted. For this, it is essential to reduce the furnace temperature and to empty the furnace.

The object of the invention is to provide a device with which the deposits in the furnace chamber or charging chamber can be removed in a simple and efficient manner, without substantially impairing the progress of production.

In particular, the object is accomplished through a device for removing residues in a furnace chamber or charging chamber of a furnace, in particular of a sintering furnace, that comprises a scraper frame, which is designed such that it can be inserted into the furnace chamber and moved therein, as well as at least one scraper element that is arranged on the scraper frame such that, by means of the scraper element, the residues can be removed at least on side walls and/or a ceiling of the furnace chamber, when the scraper frame or the device is moved.

An essential aspect of the invention consists in that the device (scraper), like the goods to be sintered, i.e., the actual charge, is movable such that the device can be pushed through the furnace chamber without great expense. This can take place in a separate pass, but, optionally, together with the charge during a sintering process or such treatment.

The device with the scraper element (i.e., the scraper) reliably removes the undesired deposits in that the scraper element is passed along the furnace chamber surfaces to be treated. Thus, laborious and time-consuming cleaning procedures can be avoided. By means of the device, the necessary clearance zone is regularly cleared, resulting in problem-free transport of the charge through the furnace. Moreover, the device can be filled with substances to purify the atmosphere in the furnace chamber. Thus, graphite felt wastes can be introduced into the furnace to bind and convert the oxygen present in the silicon dioxide to form carbon monoxide (CO).

In a first preferred embodiment, the scraper frame is designed such that it can be attached on a push plate for conveyance of the device by means of a conveying element of the furnace and is thus movable in the furnace chamber. The push plate preferably corresponds to those that are used to push the charge through the furnace. Thus, the conveying means of the furnace can also be used on the device and the cleaning expenditure is minimized. Customarily, a guideway is provided as conveying means.

In another preferred embodiment, the scraper frame is designed as a box element, comprising two side wall elements, a rear wall element, and a top element. The above-described push plate that is also used for the transport of the conventional charge serves here as the floor element of the scraper frame. The dimensions of the scraper frame are preferably selected such that they correspond roughly to those of the push plate. Thus, a sort of "ash box" is provided.

In principle, it is, of course, possible to design the box element with its own floor element and to then attach the entire arrangement on the push plate.

The box element has, on a front side provided in the use of the box element, an opening for intake of the residues into the interior of the box element, which opening preferably extends over the entire front side. In other words, the box element is preferably open on its front side such that the residues scraped off can fall into the box element.

One embodiment provides that the scraper element on the front side of the box element, protruding beyond it in the direction of the side walls and/or the ceiling of the furnace chamber, is arranged on at least one side wall element and/or top element (simply stated: the scraper element points outward). Here, the term "front side" means the forward side in the push direction. The scraper element arranged there can thus be brought into contact with the inside wall of the furnace chamber in a simple manner.

The scraper element protrudes beyond the scraper frame or beyond the box element (i.e., beyond its cross-section) in the direction of the inside wall of the furnace chamber or charging chamber, preferably by roughly 5 mm. In other words, the region of the device having the scraper element is curved in the direction of the inside wall of the furnace chamber or the region is offset in this direction relative to the side wall element or the top element.

To ensure reliable engagement of scraper element in the deposits, the scraper element thus protrudes, for example, at an angle, beyond the side wall element and/or top element, preferably at an angle of 0° to 20°, particularly preferably at an angle of 5° to 15°. Thus, the box element itself is prevented from coming into contact with the wall of the furnace and being skewed.

Preferably, the scraper element is designed as a bevel on a front face of the side wall element and/or top elements, with the bevel running such that an opening cross-section of the opening is enlarged. The bevel has, for example, an angle of 5° to 50°, preferably an angle of 30° or 45°, relative to the side wall element or top element on which the scraper element is arranged.

Provision is made according to the invention that the scraper element preferably extends as a cutting edge on the side wall element and/or top element over its entire length. Thus, a relatively large region of the wall can be targeted.

In order for the walls of the furnace to be freed of the undesired deposits as completely as possible in one pass, a scraper element or a cutting edge is advantageously arranged in each case on each side wall element and on the top element.

For a particularly simple method of production of the device, the scraper element is formed in one piece with the side wall element and/or the top element and preferably made of the same material as the scraper frame or the box element.

Alternatively, it is possible to provide the scraper element as an independent component that can be mounted on the box element. The scraper element is thus exchangeable and can be provided in a wide variety of materials.

In one embodiment, a partition element is arranged between the side wall elements and substantially parallel thereto for stabilization of the box element. The box element is thus divided, for example, into two chambers. Depending on the size of the box element, a plurality of stabilization walls can even be provided.

The side wall elements can be designed tapered in a direction from the push plate to the top element at least on the front side of the box element. In other words, the top element covers the push plate only partially (is set back). The thus designed opening of the box element enables intake of the residues scraped off as these can fall into the box element onto the floor element (the push plate).

To facilitate the emptying of the box element, in one embodiment, at least one drawer element can be inserted into the box element through the opening. The drawer element then rests on the push plate and thus enables intake of the residues into the box element. For removal of the residues from the box element, the drawer element can preferably be completely removed from the scraper frame or the box element and can be emptied.

When the box element is configured with a partition element, a drawer element can be arranged in each case between the side walls and the partition element. For a plurality of partition elements, a plurality of drawer elements are accordingly provided.

The top element can also have on an upper side at least one opening for intake of the residues into the box element. The deposit particles falling on the device during the cleaning process can thus be taken directly into the box element.

Preferably, the individual elements of the box element, i.e., the side wall elements, the rear wall element, the top element, and the partition element are connected to each other by means of a bolt, rivet, or plug-in connection or by means of an adhesive or welded connection, or the like. The box element itself can then likewise be attached on the push plate by means of one of these types of connections. This ensures high stability of the device.

Preferably, the box element is designed such that it corresponds at least partially in its external geometry substantially to the internal geometry of the furnace chamber. The box element can thus be designed substantially in the shape of a cube and somewhat larger in its dimensions than a normal charge. The scraper element or the scraper elements can thus be precisely guided to the inside wall of the furnace chamber.

Alternatively, the box element can be designed tapered in a direction from the front side to the rear wall element, i.e., in the shape of a funnel or even a trapezoid. With this configuration, skewing of the scraper frame itself can be reliably prevented.

The push plate has, on a lower side facing away from the box element, a groove for placement of the device on a guide element of the conveying element of the furnace. Since the device is intended to be guided through the furnace like a charge, the conveying element arranged for this in the furnace, i.e., for example, a guideway or a conveyor belt, can be used. The proper alignment of the device on the conveying element is effected by the guide element engaging in the groove.

Advantageously, the box element and scraper element are made of graphite. If the scraper element is provided as an independent component, it can be made of a different material (for example, a material that is harder than graphite). Thus, the scraper element (also cutting element or cutting edge) can be provided made, for example, of steel, which is then attached on the box element. For this, a bolt connection (see the above-mentioned types of connections) would also be conceivable.

In a preferred embodiment, the scraper frame has at least one predetermined breaking point on one of the side wall elements, on the rear wall element, on the partition element, and/or on the top element such that the device can be broken in the event of jamming in the furnace chamber during the removal of the residues. In other words, as soon as a specific, defined stress acts on the scraper frame or the device or is exceeded (during engagement of the scraper element or the scraper elements in the furnace residues), the scraper frame breaks and jamming of the frame in the furnace is prevented. Otherwise, the cleaning process or the firing process would be interrupted or at least hampered. The predetermined breaking point can be provided, for example, as a groove that reduces the wall thicknesses of the wall elements.

Expediently, with the use of a scraper frame with a predetermined breaking point, a device for the removal of broken parts of the scraper frame is used. In other words, behind the device for removing residues, a so-called "empty pusher" must be guided through the furnace chamber such that the broken "scraper" can be gotten out of the way.

Figure 2:
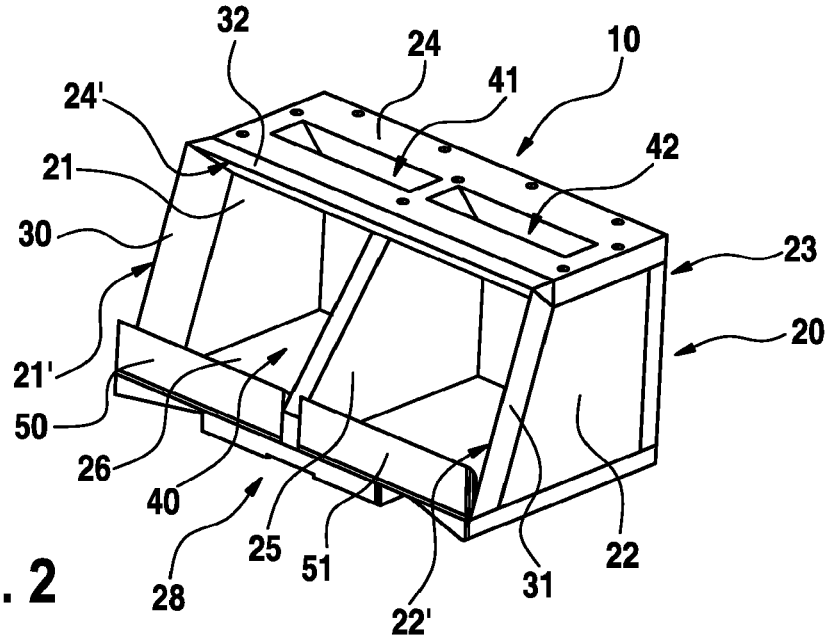
Figure 3:
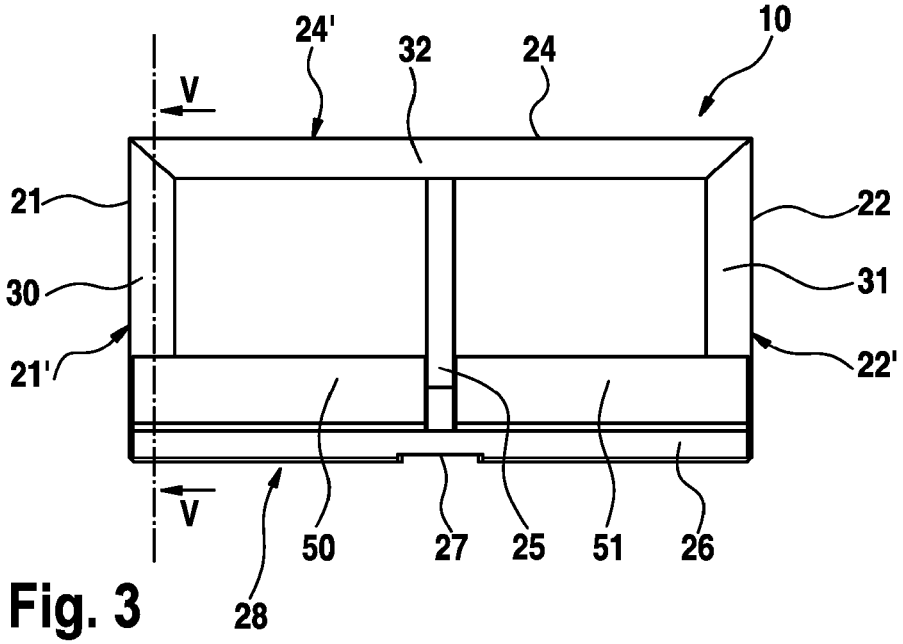
Figure 4:
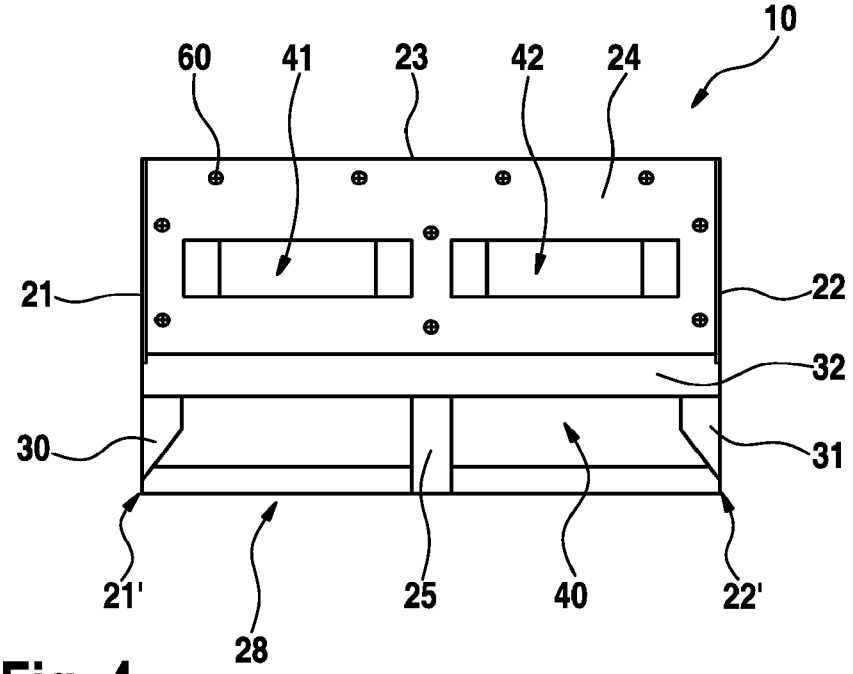
Figure 5:
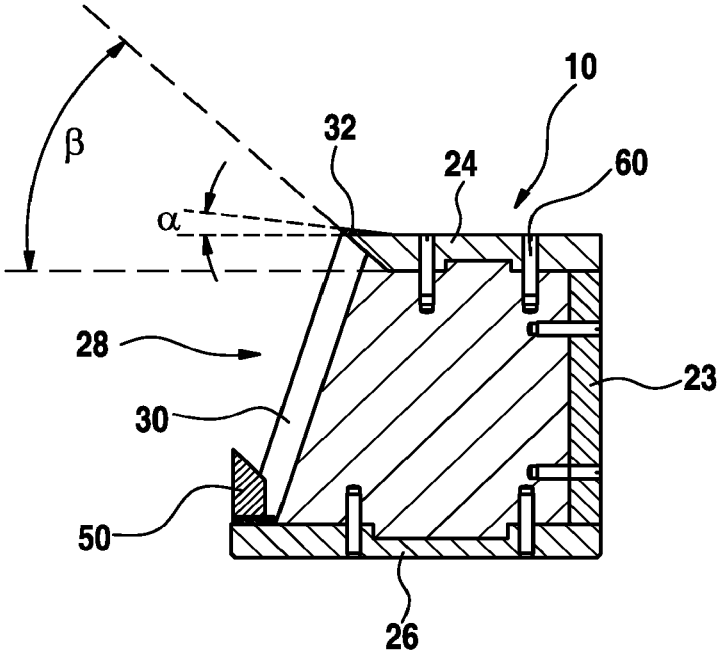
Figure 6:
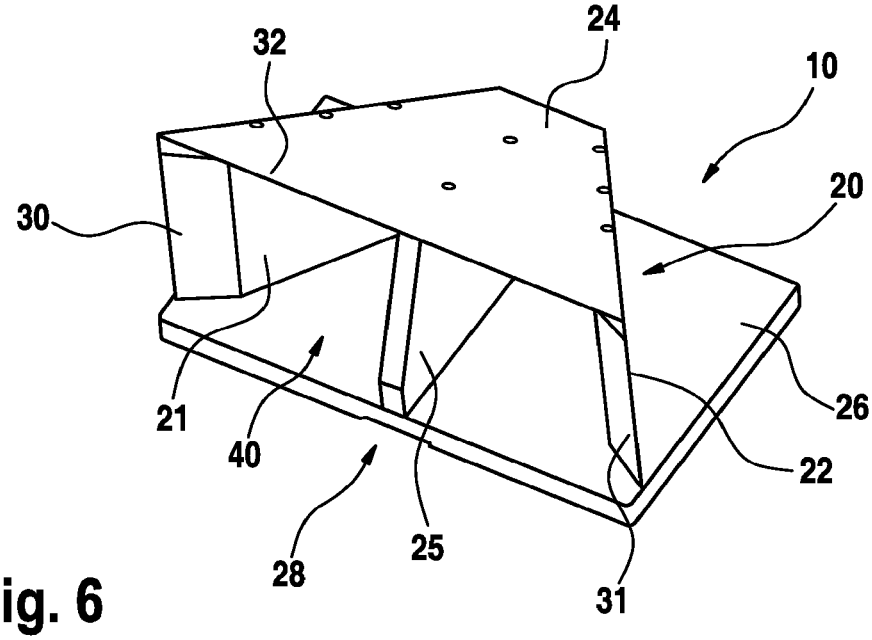

In the following, exemplary embodiments of the invention are explained in detail with reference to drawings. They depict:

FIG. 1 an embodiment of the device according to the invention in a perspective view;

FIG. 2 the environment of FIG. 1 in another perspective view;

FIG. 3 a view of the front side of the embodiment of FIG. 2;

FIG. 4 a plan view of the embodiment of FIG. 1;

FIG. 5 a side view of the embodiment of FIG. 1, wherein this is depicted in the cross-section along the line V-V of FIG. 2;

FIG. 6 another embodiment of the device according to invention in a perspective view.

In the following description, the same reference characters are used for identical and identically functioning parts.

FIG. 1 depicts, in a perspective view, a device 10 according to the invention for removing residues in a furnace chamber or charging chamber of a furnace, in particular of a sintering furnace. The device is, however, suited for all types of furnaces, whose furnace chamber must be regularly cleaned and freed of deposits and residues from the treatment processes.

The device is provided to be guided through the furnace and, at that time, to remove deposits on the inside walls of the furnace chamber, in particular on the side walls and/or the ceiling. The (scraping) device 10 regularly clears the necessary clearance zone and thus enables problem-free transport of the charge through the furnace. In order to make this cleaning process as simple as possible, provision is made to drive the device through the furnace like a "normal" charge and, for this, to use the conveying means (conveying element, e.g., guideway, conveyor belt) located in the furnace. The charge is conveyed or pushed through the furnace, for example, by so-called push plates on which the charge is placed. For this, the push plates customarily have a groove on a lower side facing away from the charge in which a guide element of the conveying element engages. Thus, the position of the device on the guideway is predetermined.

The device comprises a scraper frame (or box element) 20 and scraper elements 30, 31, 32 arranged thereon. The scraper frame 20 is made up of two side wall elements 21, 22, a rear wall element 23, and a top element 24. Further provided is a floor element 26. The device is thus designed as a box element that is open on a front side (defined as viewed in use) or has an opening 40.

The top element 24 overlaps the floor element 26 only partially, i.e., is designed smaller in its width than the floor element. Accordingly, the side wall elements 21, 22 are tapered, viewed from the floor element 26 in the direction of the top element 24, at least on the front side 28 of the device. The top element 24 is thus set back relative to the floor element 26 such that the opening 40 is enlarged on the front side 28. The top element 24 also has on an upper side (in this case, two) openings 41, 42.

The floor element is provided here as a push plate 26 such that the entire device 10 can be guided by simple means through the furnace chamber, as described above with the actual charge.

The scraper elements 30, 31, 32 on the box element (or scraper frame) 20 that ultimately scrape off, 30 i.e. remove, the residues on the inside walls of the furnace chamber are arranged both on the side wall elements 21, 22 and on the top element 24. The scraper elements 30, 31, 32 are designed here as an extension of the side wall elements 21, 22 of the scraper frame or of the top element 24 and protrude beyond the wall elements or the top element in the direction of the inside walls of the furnace chamber (in use). For this, the region with the scraper elements is (or the scraper elements are) offset relative to the side of wall elements 21, 22 and relative to the top element 24 in the direction of the inside walls of the furnace chamber (when the scraper element is in use inside the furnace chamber) or, as is discernible with the top element, protruding curved or angled upward in this direction. In this exemplary embodiment, the front faces 21', 22', 24' of the wall elements 21, 22 or of the top element 24 on the front side 28 of the box element 20 are beveled 5 such that an opening cross-section of the opening 40 is enlarged, with the outer edges protruding somewhat (approx. 5 mm) beyond the side wall surfaces of the side wall elements 21, 22 or beyond the top element 24—as just described. Thus, skewing of the box element itself in the furnace chamber can be prevented.

In the arrangement depicted by FIG. 1, the front face bevels are designed in roughly a 45°-angle (preferably also in the range from 5° to 30°) and are provided, in principle, as cutting edges that extend over the entire length of the side wall elements 21, 22 and the top element 24.

In the embodiment depicted here, the scraper elements 30, 31, 32 are formed in one piece with the side wall elements 21, 22 or with the top element 24. Alternatively, it would be possible to attach separate cutting edges whose material is adapted to the type of deposits. It would also be possible to design the device such that the cutting edges are exchangeable. For this, special releasable attachment means for the scraper elements would have to be provided.

Between the side wall elements 21, 22, a partition element 25 is arranged parallel to the side wall elements 21, 22 in order to stabilize the device or the box element 20. Depending on the size of the scraping device 10, a plurality of partitions could even be provided.

As already described above, the floor element is formed by the push plate 26 for conveyance of the box elements 20, with the deposits in the furnace chamber being removed during conveyance. Based on the geometry of the box element 20 and the correspondingly designed openings (on the front side and in the top element) 40, 41, 42, the deposits can fall into the box element 20 and be transported out of the furnace thereby. The deposits scraped off will accumulate on the push plate 26.

FIG. 2 depicts the embodiment of the device 10 according to FIG. 1. However, here, further details are depicted, namely drawer elements 50, 51. In order to facilitate emptying of the box element 20, the drawer elements 50, 51 that serve as collectors for the deposits and rest on the push plate 26, can be inserted or pushed into the box element. For emptying, the drawer elements can be removed from the box element 20. Because of the partition element 25, two drawer elements 50, 51 are provided in this embodiment.

The box element 20 corresponds at least partially in its external geometry substantially to the internal geometry of the furnace chamber such that the scraper elements 30, 31, 32 can be brought into contact with the side walls and the ceiling of the furnace chamber.

The device 10 can further have a predetermined breaking point 43, e.g., in the form of a groove, that serves to cause the scraper frame or the box element to break in the event of possible jamming in the furnace chamber (during the cleaning of the furnace). For the sake of clarity, the predetermined breaking point is drawn in only in FIG. 1 and provided as a dashed line to show a possible placement of the predetermined breaking point (e.g., the groove).

As soon as a certain stress is exceeded during engagement of the scraper elements in the residue in the furnace chamber, the box element breaks at the point provided for this.

In order to remove the broken parts from the furnace, a so-called "empty pusher" can be guided through the furnace behind the box element or the device 10. This can pick up the broken pieces or push them out of the furnace in front of it. A separate push plate, for example, can serve as an empty pusher.

FIG. 3 depicts the device 10 according to FIG. 1 in a front view. Here, it is possible to discern the two drawer elements 50, 51. In addition, the groove 27 in the push plate 26 in which the guide element of the conveying means engages is depicted.

FIG. 4 depicts the arrangement 10 in a plan view. On the set-back top element 24, the two openings 41, 42 that serve for the intake of the deposition particles scraped off can be discerned.

FIG. 5 depicts a side view of the arrangement 10 according to FIG. 1. A cross-section along the line V-V of FIG. 3 is shown. The individual components of the box element 20 are connected to each other by bolt connections 60. The box element 20 is also bolted onto the push plate 26. Also conceivable would be adhesive connections, plug-in connections, rivet connections, or the like.

The scraper element 32 protrudes at an angle $\alpha$ beyond the top element 24 and can thus engage with the ceiling of the furnace chamber to scrape off deposits. At the same time, the scraper element has a bevel $\beta$.

FIG. 6 depicts another embodiment of the device 10 according to the invention. Here, the box element 20 is designed in the shape of a funnel and tapered in a direction from the front side 28 to the rear wall element 23. Preferably, the side wall elements 21, 22 are also designed tapered in the direction of the rear wall element 23 such that the top element 24 slopes downward in the direction of the rear wall element 23 (i.e., toward the back). With this configuration, skewing of the box element 20 in the furnace chamber can be prevented, since the cutting or scraping edges 30, 31, 32 on the front side 28 form the largest cross-section of the device 10. By means of the funnel-shaped design, the side wall elements 21, 22 and scraper elements 30, 31 or the top element 24 and the scraper element 32 (here designed integrally with each other) can be arranged flush with each other on the external surfaces of the box element 20 such that the external surfaces form one plane in each case. The scraper elements 30, 31, 32 are formed on the interior surfaces only by beveling. However, the scraper elements can also be arranged at an angle with the wall elements or the top element and protrude beyond the wall and ceiling, as described above.

With the device 10 according to the invention, the clearance zone or charging chambers of furnaces, in particular of industrial furnaces, can be kept clear or cleared without great expense, with the device 10 being guided, in this case, in particular, pushed, through the furnace like goods to be processed. The cleaning expense can thus be kept small with high efficiency. The scraper elements can protrude from the scraper frame (offset, angled, curved and/or be provided as a mere extension of the side wall). Moreover, the scraper elements can have a bevel and/or the side walls of the scraper frame are opened in the shape of a funnel in the push direction. All combinations are possible.

LIST OF REFERENCE CHARACTERS

10 Device for removing residues in a furnace chamber of a furnace
20 Scraper frame, box element
21 Side wall element
21' Front face
22 Side wall element
22' Front face
23 Rear wall element
24 Top element
24' Front face
25 Partition element
26 Push plate, floor element
27 Groove
28 Front side
30 Scraper element
31 Scraper element
32 Scraper element
40 Opening box element
41 Opening top element
42 Opening top element
43 Predetermined breaking point
50 Drawer element
51 Drawer element
60 Bolted connection
α Angle
β Angle

The invention claimed is:

1. A device for removing residues in a furnace chamber of a furnace, the device comprising:

a scraper frame adapted to be inserted into the furnace chamber and moved therein; and at least one scraper element arranged on the scraper frame such that the at least one scraper element is adapted to remove residues from at least side walls and/or a ceiling of the furnace chamber, when the scraper frame is moved, wherein the scraper frame is a box element comprising two side wall elements, a rear wall element, a top element, and a floor element, the floor element being formed by a push plate, wherein the scraper element comprises a bevel on a front face of the two side wall elements and/or the top element, the two side wall elements and the top element having a flat inner face, and the bevel having an angle (β) of 5° to 50° with regard to the flat inner face of either the two side wall elements or the top element.

2. The device according to claim 1, wherein the scraper frame is adapted to be attached on a push plate for conveyance of the device by means of a conveying element of the furnace, the scraper frame being movable in the furnace chamber.

3. The device according to claim 1, wherein the box element has an opening for intake of the residues into the box element on a front side, the opening adapted to extend over an entire front side.

4. The device according to claim 1, wherein the scraper element on a front side of the box element protruding beyond the box element in a direction of the side walls and/or the ceiling of the furnace chamber is arranged on at least one side wall element and/or a top element.

5. The device according to claim 1, wherein the scraper element protrudes beyond the two side wall elements and/or the top element at an angle (α).

6. The device according to claim 5, wherein the angle (α) is 0° to 20°.

7. The device according to claim 5, wherein the angle (α) is 5° to 15°.

8. The device according to claim 1, wherein the scraper element extends as a cutting edge on the two side wall elements and/or the top element over an entire length of the two side wall elements and/or the top element.

9. The device according to claim 1, wherein the two side wall elements are tapered in a direction from the push plate to the top element at least on a front side of the box element.

10. The device according to claim 1, wherein the top element has on an upper side with at least one opening for intake of the residues into the box element.

11. The device according to claim 1, wherein an external geometry of the box element substantially corresponds to an internal geometry of the furnace chamber, such that the scraper element is adapted to make contact with the side walls and/or the ceiling of the furnace chamber.

12. The device according to claim 1, wherein the push plate has a groove on a lower side facing away from the box element for placing the device on a guide element of the conveying element of the furnace.

13. The device according to claim 1, wherein the box element and the scraper element are made of graphite.

14. The device according to claim 1, wherein the scraper frame has at least one set breaking point on one of the two side elements, on the rear wall element, on a partition element, and/or the top element, such that the device is adapted to break in the furnace chamber if the device jams during removal of the residues.

15. The device according to claim 1, wherein the furnace is a sintering furnace.

16. The device according to claim 1, wherein the angle (β) is 30° or 45°.

17. The device according to claim 1, further comprising a partition element along a middle portion of the box element and parallel to the side wall elements.

18. The device according to claim 1, further comprising at least one drawer element along a bottom portion of the box element.

* * * * *